US010632533B2

(12) United States Patent
Oga et al.

(10) Patent No.: US 10,632,533 B2
(45) Date of Patent: Apr. 28, 2020

(54) RAW MATERIAL FOR MAGNET, WHICH COMPRISES SM—FE BINARY ALLOY AS MAIN COMPONENT, METHOD FOR PRODUCING THE SAME, AND MAGNET

(71) Applicants: Murata Manufacturing Co., Ltd., Kyoto (JP); NATIONAL INSTITUTE OF ADVANCED INDUSTRIAL SCIENCE AND TECHNOLOGY, Tokyo (JP)

(72) Inventors: Satoshi Oga, Nagaokakyo (JP); Kenta Takagi, Nagoya (JP); Kimihiro Ozaki, Nagoya (JP)

(73) Assignees: Murata Manufacturing Co., Ltd., Kyoto (JP); NATIONAL INSTITUTE OF ADVANCED INDUSTRIAL SCIENCE AND TECHNOLOGY, Tokyo (JP)

( * ) Notice: Subject to any disclaimer, the term of this patent is extended or adjusted under 35 U.S.C. 154(b) by 15 days.

(21) Appl. No.: 16/031,891

(22) Filed: Jul. 10, 2018

(65) Prior Publication Data

US 2018/0318923 A1 Nov. 8, 2018

Related U.S. Application Data

(63) Continuation of application No. PCT/JP2017/000777, filed on Jan. 12, 2017.

(30) Foreign Application Priority Data

Jan. 28, 2016 (JP) ..... 2016-014529

(51) Int. Cl.

| | |
|---|---|
| ***B22F 1/00*** | (2006.01) |
| ***H01F 1/059*** | (2006.01) |
| ***C22C 33/02*** | (2006.01) |
| ***C22C 33/04*** | (2006.01) |
| ***C22C 38/00*** | (2006.01) |
| ***H01F 41/02*** | (2006.01) |
| *B22F 9/02* | (2006.01) |
| *B22F 9/04* | (2006.01) |

(52) U.S. Cl.

CPC ..... *B22F 1/0085* (2013.01); *B22F 1/0088* (2013.01); *C22C 33/0235* (2013.01); *C22C 33/04* (2013.01); *C22C 38/005* (2013.01); *H01F 1/059* (2013.01); *H01F 41/0253* (2013.01); *B22F 1/0044* (2013.01); *B22F 9/023* (2013.01); *B22F 2009/045* (2013.01); *B22F 2998/10* (2013.01); *C22C 33/02* (2013.01); *C22C 2202/02* (2013.01)

(58) Field of Classification Search

CPC .. B22F 1/0085; B22F 1/0088; H01F 41/0253; H01F 1/059; C22C 38/005; C22C 33/04

See application file for complete search history.

(56) References Cited

U.S. PATENT DOCUMENTS

| | | | |
|---|---|---|---|
| 2002/0011279 | A1 | 1/2002 | Sakurada et al. |
| 2002/0036558 | A1 | 3/2002 | Nakagawa et al. |

FOREIGN PATENT DOCUMENTS

| | | | |
|---|---|---|---|
| CN | 1230755 | A | 10/1999 |
| CN | 1274933 | A | 11/2000 |
| DE | 41 26 893 | A1 | 5/1992 |
| JP | H06-310316 | A | 11/1994 |
| JP | H08-316018 | A | 11/1996 |
| JP | H10-312918 | A | 11/1998 |
| JP | 2002-294413 | A | 10/2002 |
| JP | 2003-193208 | A | 7/2003 |
| JP | 3715573 | B2 | 11/2005 |

OTHER PUBLICATIONS

International Search Report issued in PCT/JP2017/000777; dated Apr. 4, 2017.

International Preliminary Report on Patentability and Written Opinion issued in PCT/JP2017/000777; dated Jul. 31, 2018.

L. Schultz et al., "Structural and hard magnetic properties of rapidly solidified Sm—Fe—N", Journal of Applied Physics, 1991, pp. 3188-3196, vol. 70.

T. Iriyama et al., "Structure and Magnetic Properties of SmFeN Prepared by Rapid-Quenching Method", Denkiseiko, Oct. 2002, pp. 235-242, vol. 73-4; with partial English language translation.

T. Hidaka et al., "Magnetic properties of rapidly quenched high remanence Zr added Sm—Fe—N isotropic powders", Applied Physics Letters, Nov. 1995, pp. 3197-3199, vol. 67.

An Office Action mailed by the Japanese Patent Office dated Sep. 24, 2019, which corresponds to Japanese Patent Application No. 2019-700621 and is related to U.S. Appl. No. 16/031,891 with English language translation.

An Office Action mailed by the Japanese Patent Office dated Nov. 8, 2019, which corresponds to Japanese Patent Application No. 2019-700621 and is related to U.S. Appl. No. 16/031,891 with English language translation.

*Primary Examiner* — Jessee R Roe

(74) *Attorney, Agent, or Firm* — Studebaker & Brackett PC

(57) ABSTRACT

A raw material for a magnet, which comprises Sm and Fe. A magnet is obtained by nitriding this raw material for a magnet. In particular, a raw material for a magnet comprises an Sm—Fe binary alloy as a main component. An intensity ratio of an $Sm_2Fe_{17}$ (024) peak to an $SmFe_7$ (110) peak is less than 0.001 as measured by an X-ray diffraction method.

3 Claims, No Drawings

RAW MATERIAL FOR MAGNET, WHICH COMPRISES SM—FE BINARY ALLOY AS MAIN COMPONENT, METHOD FOR PRODUCING THE SAME, AND MAGNET

CROSS-REFERENCE TO RELATED APPLICATIONS

This application claims benefit of priority to International Patent Application No. PCT/JP2017/000777, filed Jan. 12, 2017, and to Japanese Patent Application No. 2016-014529, filed Jan. 28, 2016, the entire contents of each are incorporated herein by reference.

BACKGROUND

Technical Field

The present disclosure relates to a raw material for a magnet, which comprises Sm and Fe, a method for producing the same, and a magnet which is obtained by nitriding the raw material for a magnet.

Background Art

Rare earth magnets are used in various applications as extremely strong permanent magnets with high magnetic flux density. As a representative rare earth magnet, it is known a neodymium magnet whose main phase is $Nd_2Fe_{14}B$. This neodymium magnet is generally added with dysprosium in order to strengthen heat resistance and coercive force. However, dysprosium has limited production areas in addition to being a hard-to-find rare earth elements, and therefore its price is not stable. Thus, it is required rare earth magnets that do not use dysprosium as much as possible.

Magnets using Sm as a rare earth can be used as rare earth magnets not using dysprosium. Such magnets containing Sm, are known as Sm—Fe—N based magnets, as described in JP 10-312918 A and JP 3715573 B.

More specifically, JP 10-312918 A describes a magnet which is an R-T-M-N based magnet containing R (R is at least one rare earth element and the Sm ratio in R is 50 atom % or more), T (T is Fe or Fe and Co), N and M (M is Zr or Zr with a part of Zr substituted with one or more of Ti, V, Cr, Nb, Hf, Ta, Mo, W, Al, C and P) wherein an amount of R is 4 to 8 atom %, an amount of N is 10 to 20 atom %, an amount of M is 2 to 10 atom % and the rest is substantially T. The magnet includes a hard magnetic phase with an R-T-N based alloy as a main phase and a soft magnetic phase composed of T (mainly αFe).

More specifically, JP 3715573 B describes a raw material for a magnet characterized in that it is substantially represented by the general formula: $R_x(T_{1-u-v-w}Cu_uM1_vM2_w)_{1-x-y}A_y$, wherein R is at least one element selected from rare earth elements including Y, T is Fe or Co, M1 is at least one element of Zr, Ti, Nb, Mo, Ta, W and Hf, M2 is at least one element of Cr, V, Mn and Ni, A is at least one element of N and B, and x, y, u, v and w are respectively atomic ratios of $0.04 \le x \le 0.2$, $0.001 \le y \le 0.2$, $0.002 \le u \le 0.2$, $0 \le v \le 0.2$ and $0 \le w \le 0.2$, it contains 0.2 to 10 volume % of a nonmagnetic phase containing 20 atomic % or more of Cu and a hard magnetic main phase, and an average crystal particle diameter of the hard magnetic main phase is 100 nm or less.

In the magnet described in JP 10-312918 A, the content of the rare earth element R is small at 4 to 8 at %, and it contains a soft magnetic phase composed of αFe. Further, in the material composition having the magnetic characteristics described in JP 3715573 B, a nonmagnetic phase containing Cu atoms of 20 at % or more in total is contained in an amount of 0.2 to 10% by volume based on the total amount of the material composition. For this reason, the magnets obtained from JP 10-312918 A and JP 3715573 B may cause a reduction in coercive force during use.

SUMMARY

The present disclosure provides a raw material for a magnet which is possible to obtain a magnet having superior magnetic characteristics by nitriding, a method for producing the same, and a magnet.

In a raw material comprising Sm and Fe for a magnet, Sm and Fe form a binary system component (an Sm—Fe binary alloy). As for the raw material for a magnet wherein the binary system is composed of only an $SmFe_7$ phase, which has a $TbCu_7$ type crystal structure, its theoretical value of saturation magnetic flux density after nitriding is high at 1.7 T, and also its Curie temperature is 520° C., which exceeds 476° C. of that of an $Sm_2Fe_{17}N_x$ compound. The present inventors have found that a magnet having superior magnetic characteristics could be obtained by nitriding a raw material for a magnet in which a proportion of the $SmFe_7$ phase in the Sm—Fe binary alloy is very high.

According to the first aspect of the present disclosure, there is provided a raw material for a magnet, which comprises an Sm—Fe binary alloy as a main component, wherein an intensity ratio of an $Sm_2Fe_{17}$ (024) peak to an $SmFe_7$ (110) peak is less than 0.001 as measured by an X-ray diffraction method.

According to the second aspect of the present disclosure, there is provided a method for producing the raw material for a magnet, which comprises subjecting a powdered base material for the raw material for a magnet, which is obtained by melting a mixture of samarium and iron, to a decomposition reaction by absorbing hydrogen and a recombination reaction by releasing hydrogen, wherein the recombination reaction is carried out at 600° C. or higher and 675° C. or lower (i.e., from 600° C. to 675° C.).

According to the third aspect of the present disclosure, there is provided a magnet comprising a nitride of the raw material for a magnet according to the first aspect of the present disclosure.

According to the present disclosure, there is provided a raw material for a magnet, which comprises an Sm—Fe binary alloy as a main component, wherein an intensity ratio of an $Sm_2Fe_{17}$ (024) peak to an $SmFe_7$ (110) peak is less than 0.001 as measured by an X-ray diffraction method, and thus which is able to produce a magnet having superior magnetic characteristics when it is nitrided. Also, there are provided a method for producing the same and the magnet.

DETAILED DESCRIPTION

The raw material for a magnet of the present disclosure is characterized in that it comprises an Sm—Fe binary alloy as a main component, wherein an intensity ratio of an $Sm_2Fe_{17}$ (024) peak to an $SmFe_7$ (110) peak as measured by an X-ray diffraction method is less than 0.001, and preferably less than 0.0005, and more preferably the $Sm_2Fe_{17}$ (024) peak is not detected. Due to having the intensity ratio of the $Sm_2Fe_{17}$ (024) peak to the $SmFe_7$ (110) peak in the above range, it is provided a raw material for a magnet, which is possible to produce a magnet having high magnetic flux density.

In the present specification, a main component means the component having the highest proportion among the components constituting the raw material for a magnet, and in the raw material for a magnet of the present disclosure, it means the Sm—Fe binary alloy.

It is possible to determine the intensity ratio of the $Sm_2Fe_{17}$ (024) peak to the $SmFe_7$ (110) peak as described above by measuring the diffraction intensity of the raw material for a magnet with an X-ray diffraction apparatus and calculating the intensity ratio of each peak.

In one embodiment, the average crystal particle diameter of the Sm—Fe binary alloy of the raw material for a magnet of the present disclosure is not particularly limited but it may be in a range of, for example, 1 μm or less, and preferably 400 nm or less. Further, it is preferably 50 nm or more. This size is larger than the average crystal particle diameter of the powder produced by a melt spinning method. By setting such the average crystal particle diameter, the oxidation resistance effect is expected.

In the present disclosure, the average crystal particle diameter is obtainable by, for example, acquiring a cross sectional image of the raw material for a magnet with a scanning transmission electron microscope (TEM) (also referred to as a TEM image hereinafter) and then using intercept method, specifically, arbitrarily drawing a plurality of straight lines, for example, 10 lines, each in the vertical direction and the horizontal direction in the TEM image, counting the number of crystal particles on each straight line, dividing the length of the straight line by the number of crystal particles and calculating the average value in the total number of vertical and horizontal straight lines, for example, 20 lines.

In one embodiment, an Sm content relative to the total amount of Sm and Fe contained in the raw material for a magnet of the present disclosure is not particularly limited but may be in the range of 9 at % or more and 14 at % or less (i.e., from 9 at % to 14 at %), for example.

The raw material for a magnet of the present disclosure can be produced as follows.

(1) Preparation of a Powdered Base Material of the Raw Material for a Magnet

Samarium and iron as starting metals are blended. Although the blending ratio of samarium and iron is not particularly limited, for example, an Sm content relative to the total amount of Sm and Fe contained in the raw material for a magnet is in the range of 9 at % or more and 14 at % or less (i.e., from 9 at % to 14 at %), and the rest is iron.

A mixture of samarium and iron blended at the above ratio is melted at a temperature of, for example, 1500 to 1700° C. to obtain a base material. And then, this is pulverized to obtain a powdered base material of the raw material for a magnet.

Although the above mentioned melting is not particularly limited, it is preferably carried out by high frequency melting.

The above mentioned pulverization can be carried out by a method known in itself. For example, it can be pulverized by crusher, stamp mill, ball mill and or the like. Through this pulverization, the above mixture is pulverized to, for example, 10 to 300 μm, preferably 10 to 50 μm, more preferably 20 to 40 μm, although not particularly limited.

(2) Hydrogen Absorption/Release Heat Treatment (HDDR Treatment)

By heat treating the powdered base material of the raw material for a magnet obtained as described above in a hydrogen atmosphere, a hydrogenation/disproportionation reaction (HD: hydrogenation disproportionation) occurs in the powdered base materials of the raw material for a magnet and the Sm—Fe binary alloy of the powdered base material of the raw material for a magnet is decomposed into the $SmH_2$ phase and the αFe phase (this heat treatment also referred to as "HD treatment" hereinafter).

In the above HD treatment, the treatment temperature is 600° C. or more and 850° C. or less (i.e., from 600° C. to 850° C.), preferably 600° C. or more and 800° C. or less (i.e., from 600° C. to 800° C.), and more preferably 650° C. or more and 750° C. or less (i.e., from 650° C. to 750° C.). With such a treatment temperature range, it is possible to avoid a grain growth that would occur after a DR treatment described below when the temperature is too low, and residual of αFe that would be generated after the DR treatment when the temperature is too high, and furthermore it enables to prevent the decrease in coercive force.

In the above HD treatment, the hydrogen pressure is 10 kPa or more and 0.1 MPa or less (i.e., from 10 kPa to 0.1 MPa), and preferably 50 kPa or more and 0.1 MPa or less (i.e., from 50 kPa to 0.1 MPa). With such a hydrogen pressure, the HD reaction proceeds sufficiently.

Following the above HD treatment, the powdered base material of the raw material for a magnet is heated under reduced pressure to discharge hydrogen, and then, a dehydrogenation/recombination reaction (DR: Desorption Recombination) is caused in the powdered base material of the raw material for a magnet under reduced pressure to reform the Sm—Fe binary alloy and generate the raw material for a magnet (this heat treatment also referred to as "DR treatment" hereinafter).

In the above DR treatment, "under reduced pressure" is 100 Pa or less, preferably 50 Pa or less, and more preferably 5 Pa or less. With such a pressure, it is possible to discharge hydrogen, and the DR reaction proceeds sufficiently.

In the above DR treatment, the treatment temperature is 600° C. or higher and 675° C. or lower, and preferably 600° C. or higher and 650° C. or lower. By adjusting the treatment temperature, the rate of dehydrogenation/recombination reaction can be controlled. With such a treatment temperature range, a transformation to the $Sm_2Fe_{17}$ phase, which would occur when the temperature of the DR reaction is too high, can be prevented.

In the above DR treatment, the heating time is 5 minutes or more and 60 minutes or less (i.e., from 5 minutes to 60 minutes), and preferably 5 minutes or more and 30 minutes or less (i.e., from 5 minutes to 30 minutes). With such a heating time, it is possible to avoid the grain growth and the transformation to the $Sm_2Fe_{17}$ phase, both of which would occur in the case of heating for a long time, and it is possible to prevent decrease in coercive force.

A series of treating methods of the above hydrogenation/decomposition reaction and dehydrogenation/recombination reaction is referred to as HDDR method. With this HDDR method, by treating the powdered base material of the raw material for a magnet, it is possible to obtain a raw material for a magnet in which the ratio of the $SmFe_7$ phase of the Sm—Fe binary alloy is very high.

(3) Nitriding Treatment

The raw material for a magnet treated as described above is heat treated under a nitrogen atmosphere or a mixed atmosphere of ammonia and hydrogen so that nitrogen is taken into the crystal (nitriding) and a magnet is obtained.

In the case of using a nitrogen gas in the above nitriding treatment, the partial pressure of nitrogen is 10 kPa or more and 100 kPa or less (i.e., from 10 kPa to 100 kPa), and preferably 50 kPa or more and 100 kPa or less (i.e., from 50 kPa to 100 kPa). With such a partial pressure of nitrogen, the nitriding reaction proceeds sufficiently.

In the case of using a mixed gas of ammonia and hydrogen in the above nitriding treatment, the partial pressure of ammonia is 20 kPa or more and 40 kPa or less (i.e., from 20 kPa to 40 kPa), and preferably 25 kPa or more and 33 kPa or less (i.e., from 25 kPa to 33 kPa), when the total pressure of the mixed gas is 0.1 MPa. With such a partial pressure of ammonia, the nitriding reaction proceeds sufficiently.

In the above nitriding treatment, the heating temperature is 350° C. or more and 500° C. or less (i.e., from 350° C. to 500° C.), and preferably 400° C. or more and 500° C. or less (i.e., from 400° C. to 500° C.). With such a heating temperature, it is possible to prevent a decomposition into SmN and Fe which would occur when the nitriding is performed at a higher temperature, and to proceed the nitriding reaction sufficiently as compared with case of reaction at lower temperature.

In the case of using nitrogen gas in the above nitriding treatment, the heating time is 5 hours or more and 30 hours or less (i.e., from 5 hours to 30 hours), and preferably 10 hours or more and 25 hours or less (i.e., from 10 hours to 25 hours). With such a heating time, it is possible to prevent the grain growth and the decomposition into SmN and Fe, which would occur when the heating time is longer, and to proceed the reaction sufficiently as compared with the case of shorter time. By adjusting such a heating time, the amount of nitrogen taken in the magnet powder can be adjusted.

In the case of using a mixed gas of ammonia and hydrogen in the above nitriding treatment, the heating time is 10 minutes or more 70 minutes or less (i.e., from 10 minutes to 70 minutes), and preferably 15 minutes or more 60 minutes or less (i.e., from 15 minutes to 60 minutes). With such a heating time, it is possible to prevent the grain growth and the decomposition into SmN and Fe, which would occur when the heating time is longer, and to proceed the reaction sufficiently as compared with the case of shorter time. By adjusting such a heating time, the amount of nitrogen taken in the magnet powder can be adjusted.

The magnet of the present disclosure obtained by the method including the above treatments (1) to (3) has a high magnetic flux density because the ratio of the $SmFe_7$ phase of the Sm—Fe binary alloy is very high.

That is, the present disclosure also provides a method for producing the raw material for a magnet, which comprises subjecting the powdered base material of the raw material for a magnet, which is obtained by melting a mixture of samarium and iron, to the decomposition reaction by absorbing hydrogen and the recombination reaction by releasing hydrogen, wherein the recombination reaction is carried out at 600° C. or higher and 675° C. or lower.

Furthermore, the present disclosure also provides a magnet comprising a nitride of the raw material for a magnet of the present disclosure.

EXAMPLES

Examples

Examples 1 to 12 and Comparative Examples 13 to 15

Samarium and iron as the raw material metals were weighed so as to be an Sm content relative to the total amount of samarium and iron described in the "Sm Amount (at %)" column in Table 1. Those were melted at 1600° C. in a high frequency melting furnace to obtain a base material. This base material was pulverized to 45 μm or less by a stamp mill.

The pulverized base material was subjected to the HDDR treatment, in which the HD treatment temperature was set to the temperature described in the "HD (° C.)" column in Table 1 and the DR treatment temperature was set to the temperature described in the "DR (° C.)" column in Table 1, to obtain a raw material for a magnet. The hydrogen pressure for the HD treatment was 0.1 MPa and the hydrogen pressure for the DR treatment was 5 Pa or less. In addition, the treatment time of the HD treatment was set to 30 minutes and the treatment time of the DR treatment was set to 60 minutes.

(Evaluations)

Analysis by an X-Ray Diffraction Method

For each of the raw material for a magnet of Examples 1 to 12 and Comparative Examples 13 to 15 obtained above, the diffraction intensity of the magnetic powder was measured using an X-ray diffractometer (Empyrean manufactured by Spectris Corporation) and an X-ray detector (Pixcel 1D manufactured by Spectris Corporation), with a step width of 0.013° and a step time of 20.4 seconds, and the ratio ($I_2/I_1$) of the intensity ($I_2$) of the $Sm_2Fe_{17}$ (024) peak to the intensity ($I_1$) of the $SmFe_7$ (110) peak was calculated. The results are also shown in Table 1.

TABLE 1

| | Sample No. | Sm Amount (at %) | HD (° C.) | DR (° C.) | $SmFe_7$(110) 2Θ (°) | $SmFe_7$(110) $I_1$ | $Sm_2Fe_{17}$(024) 2Θ (°) | $Sm_2Fe_{17}$(024) $I_2$ | Intensity Ratio ($I_2/I_3$) |
|---|---|---|---|---|---|---|---|---|---|
| Example | 1 | 9 | 600 | 600 | 42.656 | 8.9 | — | 0.000 | 0.000 |
| | 2 | 11 | 600 | 600 | 42.701 | 8.2 | — | 0.000 | 0.000 |
| | 3 | 14 | 600 | 600 | 42.59 | 6.5 | — | 0.000 | 0.000 |
| | 4 | 9 | 650 | 650 | 42 598 | 337 | — | 0.000 | 0.000 |
| | 5 | 11 | 650 | 650 | 42.616 | 330 | — | 0.000 | 0.000 |
| | 6 | 14 | 650 | 650 | 42.612 | 321 | — | 0.000 | 0.000 |
| | 7 | 14 | 725 | 650 | 42.627 | 499 | — | 0.000 | 0.000 |
| | 8 | 14 | 725 | 675 | 42.591 | 467 | — | 0.000 | 0.000 |
| | 9 | 14 | 775 | 650 | 42.591 | 475 | — | 0.000 | 0.000 |
| | 10 | 9 | 775 | 675 | 42.56 | 375 | — | 0.000 | 0.000 |
| | 11 | 11 | 775 | 675 | 42.551 | 370 | — | 0.000 | 0.000 |
| | 12 | 14 | 775 | 675 | 42.539 | 367 | — | 0.000 | 0.000 |
| Comparative Example | 13 | 14 | 725 | 700 | 42.512 | 426 | 44.144 | 69.71 | 0.164 |
| | 14 | 14 | 775 | 700 | 42.479 | 480 | 44.100 | 78.00 | 0.163 |
| | 15 | 14 | 800 | 800 | 42.486 | 1292 | 44.149 | 219.0 | 0.216 |

As shown in Table 1, in Examples 1 to 12, since the intensity of the $Sm_2Fe_{17}$ (024) peak of the obtained raw material for a magnet was lower than the detection limit value, the intensity ratio of the $Sm_2Fe_{17}$ (024) peak to the $SmFe_7$ (110) peak was 0.000. That is, in accordance with the present disclosure, it was confirmed that a raw material for a magnet having a very high ratio occupied by the $SmFe_7$ phase of the Sm—Fe binary alloy was obtained.

On the other hand, in Comparative Examples 13 to 15, the intensity ratio of the $Sm_2Fe_{17}$ (024) peak to the $SmFe_7$ (110) peak of the obtained raw material for a magnet increased as the DR treatment temperature was higher. That is, it was confirmed an increase in the $Sm_2Fe_{17}$ phase ratio accompanied by the increase in the DR treatment temperature.

A magnetic powder of the present disclosure can be widely used variously in motor applications such as automotive or electric tools, household appliance, communication equipment and the like.

The invention claimed is:

1. A raw material for a magnet, which comprises an Sm—Fe binary alloy as a main component, wherein an intensity ratio of an $Sm_2Fe_{17}$ (024) peak to an $SmFe_7$ (110) peak is less than 0.001 as measured by an X-ray diffraction method, wherein an Sm content in a total amount of Sm and Fe contained in the raw material for a magnet is from 9 at % to 14 at %.

2. A method for producing the raw material for a magnet according to claim 1, which comprises:

subjecting a powdered base material for the raw material for a magnet, which is obtained by melting a mixture of samarium and iron, to a decomposition reaction by absorbing hydrogen and a recombination reaction by releasing hydrogen, wherein the recombination reaction is carried out at a temperature from 600° C. to 675° C.

3. A magnet comprising a nitride of the raw material for a magnet according to claim 1.

* * * * *